US005453211A

United States Patent [19]

Alward

[11] Patent Number: 5,453,211

[45] Date of Patent: Sep. 26, 1995

[54] TETRALINS OR A COMBINATION OF TETRLINS AND ORGANIC SULFIDES AS LUBE OIL ANTI-OXIDANTS

[75] Inventor: Sandra J. Alward, Sarnia, Canada

[73] Assignee: Exxon Research & Engineering Co., Florham Park, N.J.

[21] Appl. No.: 155,407

[22] Filed: Nov. 19, 1993

[51] Int. Cl.[6] ..... C10M 127/00; C10M 135/00

[52] U.S. Cl. ..... 252/45; 585/11; 585/13

[58] Field of Search ..... 252/45; 585/11, 585/13

[56] References Cited

U.S. PATENT DOCUMENTS

| | | | |
|---|---|---|---|
| 2,167,064 | 7/1939 | Dietrich | 585/11 X |
| 2,427,766 | 9/1947 | Diamond | 252/42.7 |
| 3,785,974 | 1/1974 | Scott | 585/13 X |
| 3,812,035 | 5/1974 | Krenowicz et al. | 585/11 |

FOREIGN PATENT DOCUMENTS

| | | | |
|---|---|---|---|
| 1135455 | 8/1962 | Germany . | |
| 1152188 | 6/1989 | Japan | C10G/29/28 |
| 1296907 | 11/1972 | United Kingdom . | |
| 1358961 | 7/1974 | United Kingdom | C10M/1/20 |
| 1399815 | 7/1975 | United Kingdom | C10M/1/16 |
| 1399814 | 7/1975 | United Kingdom | C10M/1/16 |

OTHER PUBLICATIONS

Grant & Hackh's Chemical Dictionary, 5th Edition, p. 175.

Morrison, R. T., and R. N. Boyd, *Organic Chemistry* 5th ed. Boston: Allyn and Bacon, 1987.

*Primary Examiner*—Prince Willis, Jr.
*Assistant Examiner*—Cephia D. Toomer
*Attorney, Agent, or Firm*—Joseph J. Allocca

[57] ABSTRACT

The oxidation stability of lube base oils is improved by the addition of tetralins or combination of tetralins and organic sulfides. The addition of tetralins or combination of tetralins and organic sulfides to formulated lube oils has also been found to improve the oxidation stability of such formulated oil.

7 Claims, No Drawings

TETRALINS OR A COMBINATION OF TETRLINS AND ORGANIC SULFIDES AS LUBE OIL ANTI-OXIDANTS

BACKGROUND OF THE INVENTION

1. Field of the Invention

The oxidation stability of lube oil basestocks and formulated lube oils is improved by the addition of minor amounts of tetralins, alkylated tetralins or mixtures thereof, or the combination of tetralins alkylated tetralins or mixtures thereof and organic sulfides to the oil. The lube oil may be obtained from any source such as natural naphthenic or paraffinic petroleum hydrocarbon oil, tar sands or shale oil, or synthetic oils such as poly alpha olefins, synthetic ester oils, oils produced by the isomerization of slack waxes or hydrocarbon synthesis waxes (e.g. Fischer-Tropsch waxes), etc.

2. Description of the Prior Art

The inhibition or elimination of oxidation in lube oils is a long sought after goal. With increased levels of refining of lube oils to meet ever increasing performance demands and oil specifications regarding viscosity index, color, viscosity, cold cranking simulation performance, etc., natural anti-oxidants are removed from the oil and oxidation becomes a problem to be addressed because associated with oil oxidation is an increase in the tendency of an oil to form acidic components which render the oil corrosive.

U.S. Pat. No. 3,812,035 teaches a lubricating oil composition which contains A(i) 5–30 wt % trialkyl-substituted tetrahydronaphthalene (trialkylsubstituted tetralin), (ii) and 61–92 wt % di-n-($C_6$–$C_{18}$) alkyl-phenyl hydrocarbons and B 11–100 pts/100 part A of a mineral lube oil selected from pale oil, naphthenic oil and bright stock. The resulting oil combination is reported as exhibiting a synergistic effect with respect to oxidation resistance and solidification point.

U.S. Pat. No. 2,427,766 teaches a compounded lubricating oil which exhibits resistance to oxidation. The oils are highly refined and substantially free of olefinic hydrocarbons and contain two stabilizing additives selected form the classes of oil-soluble organic sulfides and polynuclear aromatic compounds. The patent reports that the aromatic hydrocarbons have little anti-oxidant properties by themselves.

GB 1,296,907 teaches an anti-oxidant composition. That composition comprises 5–70 parts by weight 9, 10 di hydroanthracene which exhibits synergistic interaction when combined with 2 to 30 parts by weight of certain known anti-oxidants. The 9, 10-di hydroanthracene is described as being in itself oxidatively unstable, but synergistically anti-oxidative when combined with peroxide decomposing anti-oxidants such as dialkyl and diaryl monosulfides, di alkyl and diaryl disulfides, zinc dialkyl dithiophosphates and dialkyl thiocarboxylates. This combination is useful for stabilizing mineral oils and synthetic esters. The patent also indicates, however, that there was little or no anti-oxidation synergism for the combination of 2-n-propyltetralin and organic sulfide when used in liquid paraffin oils.

Japanese 01-152188 discloses a process wherein fluid cat cracked fuel oil is color stabilized by hydrogenation. The hydrogenation process produces greater than 0.5% tetralin or indane in the fuel oil. The addition of $C_4$–$C_{15}$ alkyl sulfides to the fuel oil further stabilizes color. Alternatively, the hydrogenated oil can be mixed with 0.2 to 5 wt % of a lube oil containing 200 ppm or more (based on sulfur) of a sulfide and 5 wt % or more tetralin and/or indane producing a fuel oil of good color stability.

The Present Invention

It has been discovered that the ability of lubricating oil basestocks and formulated lubricating oils to resist oxidation is improved, as compared to their base performance, by the use of additives selected from tetralins or alkylated tetralins or mixtures thereof or the combination of tetralins or alkylated tetralins or mixtures thereof and organic sulfides.

Tetralins are also known in chemical literature as tetrahydronaphthalene and is represented by the formula:

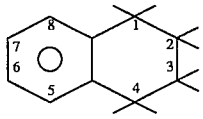

In the present invention tetralin or its alkylated derivatives may be employed. The alkyl groups which may be employed include $C_1$–$C_{24}$ alkyl group and may be substituted onto either the aromatic ring or fused non-aromatic ring.

Multiple substitutions involving the same or different alkyl groups may also be made on the basic tetralin structure, again on either the aromatic ring, the non-aromatic ring or on both.

The alkyl group may also contain sulfur constituents, either as part of the fundamental alkyl backbone of the molecule or as a substituent.

The tetralin or alkyl substituted tetralin or mixtures thereof can be used either alone or in combination with an organic sulfide or mixture of organic sulfides. The organic sulfide may be any ($C_1$–$C_{24}$) alkyl or arylsuifide, ($C_1$–$C_{24}$) dialkyl or di-aryl sulfide or $C_1$–$C_{24}$ mono or poly alkyl substituted aryl or di-aryl sulfide. The organic sulfide may also contain metallic components, e.g., calcium, barium, magnesium, strontium, copper, zinc, aluminum, lead, iron, nickel, cobalt, manganese, chromium, tin. Thus, materials such as zinc dialkyl dithiophosphate may also be employed. Other suitable materials include dialkyl thiocarboxylates. The sulfur may be either part of the molecule backbone or a substituent on the backbone or may form part of an aromatic ring (e.g. heterocycle aromatic e.g. thiophene, benzothiophene, etc.).

The lubricating oils which can be benefitted from addition of the above described materials are derived from any natural oil, such as natural naphthenic or paraffinic hydrocarbon petroleum oil, or tar sand oil or shale oil, or synthetic oil such as poly alpha olefins, synthetic esters, wax isomerate oils produced by the hydroisomerization of slack wax or waxy oil or synthetic wax (e.g. Fischer Tropsch wax) etc. Lubricating oils are defined as the oil fraction boiling above about 280° C., preferably above about 320° C. and typically in the range 300° to 650° C. The oxidative stability of the oil is improved in general by adding from 0.001 to 3 wt % tetralin or alkyl substituted tetralin and from 0 to 0.1 wt % organic sulfide based on the elemental sulfur content of the organic sulfide to the oil.

Within the broad ranges recited above the specific additive combination and amount used are dependent, to some extent, on the nature and source of the oil being treated and on the purpose of the treatment.

Natural petroleum oils or synthetic oils produced by the isomerization of slack wax or waxy oil or synthetic waxes (e.g. hydrocarbon syntheses waxes, i.e. Fischer Tropsch wax) improve their oxidation storage stability by using from 0.001 to 1.0 wt % tetralin or alkylsubstituted tetralin, preferably 0.001 to 0.1 wt %, more preferably 0.01 to 0.05 wt % tetralin or alkylsubstituted tetralin. An amount of organic sulfide ranging from 0 to 0.1 wt %, preferably 0 to 0.05 wt %, most preferably 0 to 0.02 wt %, based on the elemental sulfur content of the organic sulfide, may be used in combination with the tetralin or alkyl substituted tetralin. It is not necessary to employ organic sulfides when treating such oils. If they have been severely hydrotreated to reduce their inherent sulfur contents thereby reducing the level of natural anti-oxidation sulfur compounds present in said oil the addition of organic sulfides may be desirable. It is preferred, in such instances, to use organic sulfides of low to moderate molecular weight (e.g. 90 to 120 g/mole) and low boiling point (less than about 140° C.) to facilitate their removal (e.g. by distillation) from said oil prior to the oil being compounded or combined with commercial additive packages to produce a formulated oil.

Alternatively, tetralin or alkylsubstituted tetralin can be added to the oil in an amount ranging from 0.01 to 3 wt %, preferably 0.1 to 2 wt % in combination with 0 to 0.1 wt %, preferably 0 to 0.02 wt % organic sulfide, based on the elemental sulfur content of the organic sulfide, when the oil is being combined with additives to produce a formulated oil. The tetralin or alkyl substituted tetralin with or without organic sulfides in this instance constitute part of the additive package. In this instance the organic sulfide typically has a high molecular weight, (e.g. at least about 200 to 500 g/mole) and typically a high boiling point (e.g. above about 300° C., preferably 400° C.) to insure that it remains in the oil and is not boiled off during use.

The present invention is illustrated in the following non-limiting examples.

EXAMPLE 1

A 25 gram sample of slack wax isomerate base oil was oxidized in the copper catalyzed IP 306 oxidation test. The total oxidation products were determined to be 13.82 wt %.

EXAMPLE 2

A sample of 1, 2, 3, 4-tetrahydronaphthalene (0.5999 g) was added to the slack wax isomerate base oil (29.4001 g) of Example 1 and the mixture was stirred to give a homogeneous solution (2 wt % tetralin). A 25 gram aliquot was oxidized in the copper catalyzed IP 306 oxidation test (Copper catalyst, 120° C., 1 liter/hr oxygen bubbling through sample, 48 hour test duration). The total oxidation products were determined to be 0.44 wt %.

EXAMPLE 3

A sample of 1, 2, 3, 4-tetrahydronaphthalene (0.2999 g) was added to the slack wax isomerate base oil (29.7001 g) of Example 1 and the mixture was stirred to give a homogeneous solution (1 wt % tetralin). A 25 gram aliquot was oxidized in the copper catalyzed IP 306 oxidation test, previously described. The total oxidation products were determined to be 5.67 wt %.

EXAMPLE 4

A sample of 1, 2, 3, 4-tetrahydronaphthalene (0.1500 g) was added to the slack wax isomerate base oil (29.8498 g) of Example 1 and the mixture was stirred to give a homogeneous solution (0.5 wt % tetralin). A 25 gram aliquot was oxidized in the copper catalyzed IP 306 oxidation test, previously described. The total oxidation products were determined to be 9.59 wt %.

EXAMPLE 5

A sample of the $C_{16}$ alkylate of tetralin (0.6002 g) was added to the slack wax isomerate base oil (29.3995 g) of Example 1 and the mixture was stirred to give a homogeneous solution (2 wt % alkylated tetralin). A 25 gram aliquot was oxidized in the copper catalyzed IP 306 oxidation test, previously described. The total oxidation products were determined to be 0.54 wt %.

EXAMPLE 6

A sample of the $C_{16}$ alkylate of tetralin (0.1502 g) was added to the slack wax isomerate base oil (29.8496 g) of Example 1 and the mixture was stirred to give a homogeneous solution (0.5 wt % alkylated tetralin). A 25 gram aliquot was oxidized in the copper catalyzed IP 306 oxidation test, previously described. The total oxidation products were determined to be 10.46 wt %.

EXAMPLE 7

A 25 gram sample of synthetic (Fischer Tropsch) wax isomerate base oil was oxidized in the copper catalyzed IP306 oxidation test, previously described. The total oxidation products were determined to be 13.85 wt %.

EXAMPLE 8

A sample of the $C_{16}$ alkylate of tetralin (0.5960 g) was added to the synthetic wax isomerate base oil (29.2038 g) of Example 7 and the mixture was stirred to give a homogeneous solution (2 wt % alkylated tetralin). A 25 gram aliquot was oxidized in the copper catalyzed IP306 oxidation test, previously described. The total oxidation products were determined to be 17.45 wt %.

EXAMPLE 9

A sample of 2-n-dodecyltetrahydropthiophene (0.0487 g) was added to the synthetic wax isomerate base oil (30.3261 g) of Example 7 and the mixture was stirred to give a homogeneous solution (0.16 wt % thiophene (0.02 wt % sulfur)). A 25 gram aliquot was oxidized in the copper catalyzed IP306 oxidation test, previously described. The total oxidation products were determined to be 14.91 wt %.

EXAMPLE 10

A sample of the $C_{16}$ alkylate of tetralin (0.5999 g) and 2-n-dodecyltetrahydrothiophene (0.0482 g) was added to the synthetic wax isomerate base oil (29.3522 g) of Example 7 and the mixture was stirred to give a homogeneous solution (2.0 wt % tetralin and 0.16 wt % thiophene (0.02 wt % sulfur)). A 25 gram aliquot was oxidized in the copper catalyzed IP306 oxidation test, previously described. The total oxidation products were determined to be 0.71 wt %.

The basestock inspections and results are summarized in Tables 1, 2 and 3 below.

TABLE 1

| | Basestock Inspections | |
|---|---|---|
| | Slack Wax Isomerate | Synthetic Wax Isomerate |
| Saturates, wt % | 97.9 | 96.6 |
| Aromatics, wt % | 2.2 | 0.5 |
| Sulphur, ppm | 390 | 3.1 |
| Basic Nitrogen, ppm | <2 | <1 |

TABLE 2

EFFECT OF TETRALINS ON OXIDATION STABILITY OF SLACK WAX ISOMERATE (SWI) AND SYNTHETIC WAX ISOMERATE (F-TWI)

| Additive | Additive Treat, Wt % | Base Oil | Total Oxidation Product (wt %) |
|---|---|---|---|
| — | 0 | SWI | 13.8 |
| Tetralin | 2 | SWI | 0.44 |
| $C_{16}$ Alkyl Tetralin | 2 | SWI | 0.54 |
| — | 0 | F-TWI | 13.8 |
| $C_{16}$ Alkyl Tetralin | 2 | F-TWI | 17.4 |

TABLE 3

SYNERGISM BETWEEN ALKYLATED TETRALIN AND SULPHIDE IN THE IP 306 OXIDATION TEST (F-TWI BASESTOCK)

| Additive | Additive Treat, Wt % | Base Oil | Total Oxidation Product (wt %) |
|---|---|---|---|
| — | 0 | F-TWI | 13.8 |
| $C_{16}$ Alkyl Tetralin | 2 | F-TWI | 17.4 |
| $C_{12}$ Tetra-hydrothiophene | 0.16 | F-TWI | 14.9 |
| $C_{16}$ Alkyl Tetralin + $C_{12}$ Tetra-hydrothiophene | 2<br>0.16 | F-TWI | 0.71 |

It is seen that when $C_{16}$ alkyl tetralin was used as an anti-oxidate in combination with $C_{12}$ thiophene, the two compounds acted in a synergistic fashion to control oxidation of the Fischer-Tropsch synthetic wax isomerate.

EXAMPLE 11

The concentration of oxygenate (and thus the degree of oxidation) was measured in base oils using high pressure liquid chromatography.

Various concentrations of tetralin were added to a slack wax isomerate comprising 100% saturates, 0% aromatic and less than 0.5 wppm sulfur which was then oxidized in a modified IP 306 test (25 gm of sample heated at 120° C. for 1.5 hours over 4 g iron catalyst with oxygen bubbled through the oil at a rate of 1 liter/minute). The results are presented in Table 4, below.

TABLE 4

| Tetralin Content, wt % | Oxygenates, ppm | Daylight Stability, days |
|---|---|---|
| 0 | 2500 | >78 |
| 0.001 | 772 | >60 |
| 0.01 | 0 | >60 |
| 0.05 | 44 | 13 |
| 0.1 | 156 | 13 |
| 0.2 | 128 | 13 |
| 1 | 376 | 4 |

As is seen, low concentrations of tetralin can be used to control the formation of oxygenates in slack wax isomerates. In fact, low concentrations are preferred over higher concentrations because of the negative impact on daylight stability of the dewaxed isomerate oil when higher tetralin concentrations are used. Therefore for long term storage, low tetralin concentration should be used. These low concentrations could be removed by distillation prior to the oil being combined with an additive package to produce a formulated oil.

Higher tetralin concentration (e.g. 1–3 wt %, preferably 1–2 wt %) can be employed when the base oil is being combined with additives to produce a formulated oil, the tetralin can form part of the additive package. In that instance, because the formulated oil will be shielded from daylight, the negative effect of higher tetralin concentration on daylight stability will be of little or no consequence.

It is believed that the oxygenates increased in Table 4 as the tetralin concentration increased above 0.01 wt % because the tetralin itself was being oxidized over the iron catalyst in preference to the base oil in the test, as compared to the results reported in the previous examples which used copper catalyst. This oxidation does not however prevent the tetralin {or its intermediates) from controlling the oxidation of the base oil. This is consistent with GB 1,296,907 wherein 9, 10-dihydroanthracene was described as being itself oxidatively unstable but capable of functioning synergistically with known anti-oxidants. However, contrary to the teaching of that patent, it is shown in the present invention that low concentrations of tetralin, without any other anti-oxidant present, still, in and of itself is capable of improving the oxidation stability of an oil to a level well above that demonstrated by the oil without tetralin present. One would have expected that the addition of oxidatively unstable tetralin to an oxidatively unstable oil would have resulted in no noticeable or significant overall improvement in oxidation stability, or even a net decrease in such stability.

EXAMPLE 12

The volatile acidity, soluble acidity, total sludge and total oxidation product values of slack wax isomerate (see Example 11) produced in the course of an uncatalyzed IP306 test 25 gm sample, (no catalyst, 120° C. 1 liter/hr oxygen bubbling through sample, 26–48 hours test duration) were determined. Two different concentrations of tetralin were added to separate samples of base oil the results are reported below:

| Sample | IP-306 RESULTS (Uncatalyzed) Volatile Acidity*** (mg of KOH/g) | Soluble Acidity (mg of KOH/g | Total Sludge (wt %) | Total Oxidation Product % |
|---|---|---|---|---|
| Slack wax isomerate | 4.41 | 46.7 | 1.8 | 18.2 |
| Slack wax isomerate + 0.1 wt % Tetralin | 1.72* | Sample bumped >30 hrs** | | |
| Slack wax isomerate + 1 wt % Tetralin | 0 | 0.0068 | 0.0252 | 0.027 |

*After 26 hours
**Bumped: Easily oxidized samples form water which builds up and suddenly volatilizes carrying the organic phase out of the IP-306 tube and terminating the test.
***Volatile Acidity - customers will define what constitutes a "pass" - usually <2 mg KOH/g after 48 hours.

What is claimed is:

1. A method for improving the oxidation stability of lubricating oil comprising wax isomerate oil by adding to said oil from 0.001 to 3 wt % tetralin, alkyl substituted tetralin or mixture thereof and from 0 to 0.1 wt % organic sulfides based on the elemental sulfur content of the organic sulfides.

2. The method of claim 1 wherein the amount of tetralin, alkyl substituted tetralin or mixture thereof added to the oil is in the range 0.001 to 1.0 wt %.

3. The method of claim 1 wherein the amount of tetralin, alkyl substituted tetralin or mixture thereof added to the oil is in the range 0.001 to 0.1 wt %.

4. The method of claim 1 wherein the amount of tetralin, alkyl substituted tetralin or mixture thereof added to the oil is in the range 0.01 to 3 wt %.

5. The method of claim 1 wherein the amount of tetralin, alkyl substituted tetralin or mixture thereof added to the oil is in the range 0.1 to 2 wt %.

6. The method of claim 1, 2, 3, 4 or 5 wherein the amount of organic sulfides added to the oil is in the range 0 to 0.05 wt % based on the elemental sulfur content of the organic sulfides.

7. The method of claim 6 wherein the amount of organic sulfides added to the oil is in the range 0 to 0.02 wt % based on the elemental sulfur content of the organic sulfides.

* * * * *